US005891825A

United States Patent [19]

Ushio et al.

[11] Patent Number: 5,891,825

[45] Date of Patent: Apr. 6, 1999

[54] RECORDING MATERIAL

[75] Inventors: Seiji Ushio, Chofu; Yuichiro Yoneyama, Mie-ken; Takayuki Aikawa, Hannou; Tetsuzi Ohta, Mitaka, all of Japan

[73] Assignee: Kimoto Co., Ltd., Japan

[21] Appl. No.: 851,184

[22] Filed: May 5, 1997

[30] Foreign Application Priority Data

May 10, 1996 [JP] Japan ..... 8-140961

[51] Int. Cl.[6] ..... B41M 5/00; B41M 5/035; B41M 5/38

[52] U.S. Cl. ..... 503/227; 428/40.1; 428/41.5; 428/41.6; 428/42.1; 428/195; 428/211; 428/690; 428/913; 428/914

[58] Field of Search ..... 427/21; 428/195, 428/41.5, 40.1, 41.6, 42.1, 211, 690, 913, 914; 430/523; 347/105; 503/227

[56] References Cited

U.S. PATENT DOCUMENTS

| | | | |
|---|---|---|---|
| 4,446,174 | 5/1984 | Maekawa et al. | 427/261 |
| 4,944,988 | 7/1990 | Yasuda et al. | 428/195 |
| 5,200,242 | 4/1993 | Hohmann | 428/40 |

*Primary Examiner*—Bruce H. Hess
*Attorney, Agent, or Firm*—Lorusso & Loud

[57] ABSTRACT

A recording material comprising a transparent substrate which has a recording layer on one side and a peelable hiding layer on the other side is provided. By using the recording material of the present invention, a solid image portion in white or other color, in particular, with hiding property, can be formed on a transparent substrate with easy operation.

9 Claims, No Drawings

RECORDING MATERIAL

BACKGROUND OF THE INVENTION

The present invention relates to a recording material, which can be used for gravure-proofing for package design etc., displays and the like.

Full color printing on a substrate made of paper, plastic film or the like has hitherto been performed by electrostatic recording, ink-jet printing, thermal transfer recording, electrophotography and the like. Interalia, electrostatic recording is widely used for the manufacture of large-sized displays, outdoor displays and the like because it can output images at a high speed and can produce highly weather-resistant images, and ink-jet printing is frequently used for the manufacture of recording materials for large-sized displays and gravure-proofing of package design and the like because it provides images with high resolution at low cost.

However, all of conventional recording materials used for these recording methods are classified into white ones, those in one color, those transmitting light, i.e., transparent ones, and those having a ready-made pattern.

Therefore, if partial background portions with hiding property are desired in recording materials transmitting light, for example, a white paper sheet or white film, for example, must be adhered or white paint must be applied on the background portions on a transparent sheet as a separate operation before or after printing by any of the above-mentioned methods.

To obtain such background portions with hiding property as described above, solid printed image portions in white or one color may be formed by the methods mentioned above. However, forming a large solid image portion in white or one color requires use of a large amount of toner or ink and may cause ununiform recording.

Further, inks for ink-jet printing, in particular, generally transmit light well and most of them do not have hiding property. Therefore, it is difficult to form printed image portions which have hiding property on a transparent film with such inks.

The present invention has been accomplished in order to solve these problems. The object of the present invention is therefore to provide a recording material which can provide a solid image portion in white or other color, in particular, with hiding property on a transparent substrate with easy operation.

SUMMARY OF THE INVENTION

To achieve the object mentioned above, the present invention provides a recording material comprising a transparent substrate which has a recording layer on one side and a peelable hiding layer on the other side. With this recording material of the present invention, solid image portions with hiding property, in particular, those in white or the like, independent from printed image portions, can be easily obtained by cutting out a desired pattern from the hiding layer and peeling unwanted portions of the hiding layer before or after recording.

An adhesive layer, which enables the hiding layer to be adhered to the substrate again after peeling off from the substrate, is preferably provided between the transparent substrate and the hiding layer. By providing the adhesive layer, erroneously peeled portions of the hiding layer can be conveniently adhered to the substrate again.

When the recording layer is made of a material having ink-absorbing property, the recording material of the present invention can be used as a recording material for common ink-jet printing.

When an electro-conductive layer and a dielectric layer are provided on the substrate in this order as the recording layer, the recording material of the present invention can be used as a recording material for electrostatic recording.

DETAILED DESCRIPTION OF THE INVENTION

The substrate of the recording material is preferably one having flexibility such as a plastic film made of polyester, polycarbonate, cellulose acetate, polyethylene, polystyrene, polypropylene or the like, but the material is not limited to these. It may also be a plate made of, for example, glass, provided that it can be used in the recording apparatus concerned.

The recording layer should be one suitable for one of various recording methods such as electrostatic recording, ink-jet recording, electrophotography, LBP, LED, thermo-fusion transfer, heat sublimation transfer, ion flow and the like. However, for which recording method the recording material of the present invention is suitable is not critical and the recording layer may be suitably constituted according to the desired recording method.

For example, the recording layer for electrostatic recording can be obtained by forming an electro-conductive layer and a dielectric layer on the substrate in this order.

The electro-conductive layer may be a membrane of metal or metal compound made by vapor deposition insofar as it has transparency of some extent. But it is usually formed by applying an electro-conductive agent alone or a synthetic resin containing a conductive agent on the substrate.

Examples of the conductive agent include conventional ones, for example, cationic polymer electrolytes such as polyvinylbenzyltrimethyl chlorides, polyallyltrimethylammonium chlorides and styrene/acrylic acid triethylammonium chlorides, anionic polymer electrolytes such as polystyrene sulfonates, polyacrylic acid salts and polyvinyl phosphates. Further, ion-conductive fine powder composed of zinc oxide, tin oxide, indium oxide or the like doped with antimony oxide, ammonium oxide, tin oxide or the like may suitably be used as the conductive agent.

The synthetic resin which is used for the electro-conductive layer may be one of various resins used for the electro-conductive layers of ordinary electrostatic recording materials. For example, polyesters, polyvinyl chlorides, poly (meth)acrylates, polyamides and the like can be used.

The electro-conductive layer may further contain various additives such as pigments, dispersants, fluorescent dyes, pH modifiers, antifoaming agents, wetting agents, antiseptics, antioxidants and surfactants as desired to an extent not degrading the coating property of the coating solution for the layer. The thickness of the electro-conductive layer may be varied depending on the material therefor. For example, the thickness of a synthetic resin-based electro-conductive layer is usually in a range of 0.5 to 5 $\mu$m.

When the substrate is electro-conductive, the electro-conductive layer need not necessary be provided.

The dielectric layer is usually formed by applying a synthetic resin containing a pigment on the electro-conductive layer.

The synthetic resin used for the dielectric layer is not particularly limited so long as it is an electrically insulating material. For example, one or more of polyvinyl chlorides, polyvinylidene chlorides, polyvinyl acetates, poly(meth)

acrylic acid esters, polystyrenes, butyral resins, silicone resins, epoxy resins, polyolefin resins, polyurethane resins, polyvinyl acetal resins and the like can be used.

Further, a pigment such as silica, clay, talc, diatomaceous earth, calcium carbonate, barium sulfate, aluminium silicate, synthetic zeolite, smectite, alumina, zinc oxide, titanium oxide or aluminium hydroxide is preferably mixed or dispersed in the synthetic resin in order to form a gap between the dielectric layer and the recording electrodes.

The dielectric layer may further contain various additives such as pigments, dispersants, fluorescent dyes, pH modifiers, antifoaming agents, wetting agents, antiseptics, antioxidants and surfactants as desired to an extent not degrading the coating property of the coating solution for the layer. The thickness of the dielectric layer is 1 μm or more, preferably 3 μm or more, and 20 μm or less, preferably 10 μm or less. With a thickness in this range, good electrostatic recording characteristics can be obtained.

The recording layer for ink-jet recording is formed from a resin used for conventional ink-receiving layers, i.e., is mainly formed from a hydrophilic polymer or water-soluble polymer. Examples of such hydrophilic polymer or water-soluble polymer include synthetic resins such as polyvinyl alcohols, polyvinylpyrrolidones, water-soluble cellulosic resins, water-soluble polyester resins, polyvinyl acetals, acrylic acid or acrylamide copolymers, melamine resins, polyether polyols and crosslinked versions thereof, and natural resins such as gelatin, casein, starch, chitin and chitosan. Water-soluble polymers imparted with moderate water-resistance as required may also be used. For example, one or more water-soluble resins such as polyvinyl alcohols and polyvinylpyrrolidones hardened by a conventional method and water-soluble resins having cinnamoyl groups, stilbazolium groups, stilquinolium groups, diazo groups and the like can be used.

The recording layer may further contain various additives such as pigments, dispersants, fluorescent dyes, pH modifiers, antifoaming agents, wetting agents, antiseptics, antioxidants and surfactants as desired to an extent not degrading the coating property of the coating solution for the layer.

When the substrate has ink-absorbing property, a separate recording layer need not necessary be provided.

The hiding layer of the recording material according to the present invention consists mainly of resin and colorant. It is provided on the side of the substrate opposite to the one provided with the recording layer. When the substrate also serves as the recording layer, the hiding layer is provided on the side of the substrate opposite to the recording surface.

The hiding layer must have peelability. Owing to the peelability of the hiding layer, solid image portions independent from recorded image portions can be easily obtained by cutting the hiding layer in a desired pattern and peeling off unwanted portions of the hiding layer.

The resin constituting the hiding layer may be one or more of natural or synthetic resins including vinyl resins such as vinyl acetate resins, polyurethane resins, rubber resins, polyester resins, alkyd resins, polyolefin resins, silicone resins, cellulose resins and the like. Ordinary paper, cloth, films and the like can also be used as the hiding layer by peelably adhering it to the substrate.

The colorant may be one or more of various dyes and pigments including organic pigments and inorganic pigments. In particular, when the hiding layer is white and has hiding property, for example, titanium oxide, zinc oxide, calcium carbonate, barium sulfate, silicon oxide, kaolin, clay and the like can be used.

The hiding layer may further comprise plasticizers, surfactants, pH modifiers, antioxidants, ultraviolet absorbers and the like as required. The hiding layer may also comprise a fluorescent substance as described in Japanese Patent Unexamined Publication No. Sho 63-29847. When the hiding layer contains a fluorescent substance, cut lines of the hiding layer are easily recognizable, which makes the peeling operation easy. In addition, such lines preferably enhance the visible effect as a display material.

The thickness of the hiding layer is 1 μm or more, preferably 5 μm or more, more preferably 20 μm or more. Though peeling is possible when it is 1 μm or more, the layer is likely to be broken and peeling thereof is difficult when it is 5 μm or less. When it is 20 μm or more, hiding property can be obtained easily and the layer can be peeled easily. As regards the upper limit of the thickness, it is generally 250 μm or less, preferably 100 μm or less, more preferably 50 μm or less. When it is more than 250 μm, transfer of the material in a recording apparatus of such recording methods as mentioned above may becomes difficult and the recording characteristics may be degraded. When the thickness is 100 μm or more, cutting of the layer may become difficult. In particular, when the cutting is performed with a cutting machine, good cutting property can be obtained with a thickness of 50 μm or less with little wear of the cutting edge.

The resin constituting the hiding layer is advantageously selected from among those which enable a peeled layer to be adhered to the substrate again. Examples of such resin include rubber resins such as natural rubbers and synthetic rubbers, vinyl resins such as vinyl chloride/vinyl acetate copolymers, polyurethane resins, polyester resins and the like. These resins can be used alone or in any combination thereof. For this purpose, an adhesive layer composed of such a resin as mentioned above may separately be provided between the substrate and the hiding layer. In this case, when the hiding layer is peeled, the adhesive layer remains either on the hiding layer or on the substrate.

The resin constituting the adhesive layer may be selected from various natural or synthetic resins including phenol resins, vinyl resins, polyurethane resins, polyester resins, acrylic resins, polyolefin resins, alkyd resins, various rubbers and the like. Adhesion may be controlled by adding wax, plastisizer, adhesion enhancer or the like to the layer. The adhesive layer may further contain surfactants, stabilizers, antioxidants, antiseptics and the like, and it may also contain a colorant the same as that contained in the hiding layer. Though the thickness of the adhesive layer may be varied depending on the selected material and the like, it is generally 0.5 μm or more, preferably 1 μm or more, and generally 50 μm or less, preferably 10 ρm or less. Though depending on the selected material, good adhesion can generally be obtained with a thickness of 0.5 μm or more. A layer having a thickness of 50 μm or more is difficult to cut and likely to protrude from cutting sections.

Further, a peelability control layer may be advantageously provided between the hiding layer and the substrate or between the adhesive layer and the substrate to control the adhesion.

The recording material of the present invention can be produced by applying a coating solution for each layer comprising the required resin components and the like dissolved or dispersed in a suitable solvent on a substrate with a roll coater, Mayer bar coater, air knife coater, gravure coater or the like and drying the coated layer.

EXAMPLES

The present invention will be further explained hereinafter with reference to the following examples. In the examples, "%" and "part" mean "% by weight" and "part by weight" respectively unless otherwise indicated.

Example 1

On a polyester film having a thickness of 75 μm (Lumirror Q-81, Toray Industries, Inc.), a coating solution for ink-receiving layer comprising 5 parts by weight of polyvinyl alcohol (Gohsenol GH-17, saponification degree: 86.5–90%, Nippon Synthetic Chemical Industry Co., Ltd.) dissolved in 95 parts by weight of water was applied with a bar coater and dried at 110° C. for 2 minutes to afford a recording layer for ink-jet printing having a thickness of 5 μm.

On the other side of the film, opposite to the side provided with the recording layer, a coating solution for adhesive layer comprising 25 parts by weight of adhesive (Paper Cement, effective content: 15%, Fukuoka Kogyo K.K.) dissolved in 75 parts by weight of toluene was applied with a bar coater and dried to afford an adhesive layer having a thickness of 1.5 μm. Further, on the adhesive layer, a coating solution for hiding layer comprising 9 parts by weight of nitrocellulose (HIG-2, Asahi Chemical Industry Co., Ltd.) and 9 parts by weight of castor oil dissolved in 40 parts by weight of ethyl acetate and 40 parts by weight of toluene and comprising 2 parts by weight of titanium oxide (FR-55, Furukawa Co., Ltd.) dispersed therein was coated similarly to afford a peelable white hiding layer having a thickness of 35 μm.

An image was recorded on the recording layer of the recording material for ink-jet printing obtained above with an ink-jet printer (BJC410J, Canon Inc.). Then, the hiding layer was cut and portions thereof were peeled to obtain a display material. In this display material, transparent portions and white hiding portions were observed as background through the printed image from the recording layer side. The peeled portions of the hiding layer could be easily adhered to the film again.

Example 2

On a polyester film having a thickness of 75 μm (Lumirror T-60, Toray Industries, Inc.), a coating dispersion for electro-conductive layer comprising 100 parts by weight of metal oxides composed of tin oxide and antimony oxide dispersed in 100 parts by weight of an acrylic resin dissolved in an organic solvent (Paraloyd B44, Rohm & Haas) was applied with a Mayer bar and dried to afford an electro-conductive layer having a thickness of 0.7 μm. On this electro-conductive layer, a dispersion comprising 10 parts by weight of amorphous silica (Sylysia 770, Fuji Silycia Chemical Co., Ltd.) dispersed in 100 parts by weight of an acrylic resin dissolved in an organic solvent (Paraloyd B44, Rohm & Haas) was applied with a Mayer bar and dried to afford a dielectric layer having a thickness of 6 μm.

On the other side of the film, opposite to the side provided with the recording layer, a coating solution for hiding layer comprising 16 parts by weight of a vinyl chloride/vinyl acetate copolymer (Solvain A, Nisshin Chemical Industry Co., Ltd.) and 2 parts by weight of red dye (Neozapon Red GE, BASF) dissolved in a mixed solvent of 40 parts by weight of toluene and 40 parts by weight of acetone and comprising 2 parts by weight of titanium oxide (FR-55, Furukawa Co., Ltd.) dispersed therein was coated similarly to afford a peelable red hiding layer having a thickness of 25 μm.

An image was recorded on the recording layer of the recording material for electrostatic recording obtained above with an electrostatic plotter (DCS 5400, Luster Graphic). Then, the hiding layer was cut and portions thereof were peeled to obtain a display material. In this display material, transparent portions and red hiding portions were observed as background through the printed image from the recording layer side.

When solid color image portions are desired as background in addition to a separately printed image on a transparent film, by using the recording material of the present invention, solid image portions with hiding property, in particular, those in white, can be easily obtained without an additional operation such as using a special toner, ink, apparatus and the like, adhering white paper sheet or film, applying a white paint or the like. Further, when large solid color image portions in one color are desired, the recording material of the present invention provides uniform images without using a large amount of toner or ink.

What is claimed is:

1. A recording material comprising:

a transparent substrate;

a recording layer adhered to one side of said transparent substrate; and a peelable hiding layer adhered to the whole surface of a second side of said transparent substrate, said hiding layer having an adhesiveness for said substrate providing peelability of said hiding layer from said substrate, whereby solid image portions independent from recorded image portions can be obtained by cutting the hiding layer in a desired pattern and peeling off unwanted portions of the hiding layer.

2. The recording material of claim 1, wherein said adhesiveness provides adherence of the hiding layer to the substrate again after once peeled off from the substrate.

3. The recording material of claim 1, wherein said recording layer is ink-absorbing.

4. The recording material of claim 1, wherein the recording layer comprises an electro-conductive layer and a dielectric layer.

5. The recording material of claim 1 further comprising an adhesive layer providing said adhesiveness and interposed between said hiding layer and said substrate.

6. The recording material of claim 1 wherein said hiding layer is formed of an elastomeric resin possessing said adhesiveness.

7. The recording material of claim 1 wherein said recording layer is formed of a hydrophilic polymer or a water-soluble polymer.

8. The recording material of claim 1 wherein said hiding layer is formed of a resin containing a colorant.

9. The recording material of claim 1 wherein said hiding layer contains a fluorescent substance, whereby lines cut in said hiding layer are easily recognizable.

* * * * *